US010280066B2

(12) United States Patent
Bonvino et al.

(10) Patent No.: US 10,280,066 B2
(45) Date of Patent: May 7, 2019

(54) SYSTEM OF PROTECTION FROM UNAUTHORIZED ACCESS TO A VALVE OF A TANK OF FUEL GAS

(71) Applicant: LIQUIGAS S.P.A., Milan (IT)

(72) Inventors: Marco Bonvino, Turin (IT); Luciano Garbini, Milan (IT)

(73) Assignee: Liquigas S.P.A., Brescia (BS) (IT)

( * ) Notice: Subject to any disclaimer, the term of this patent is extended or adjusted under 35 U.S.C. 154(b) by 0 days.

(21) Appl. No.: 15/765,400

(22) PCT Filed: Sep. 30, 2016

(86) PCT No.: PCT/IB2016/055856
§ 371 (c)(1),
(2) Date: Apr. 2, 2018

(87) PCT Pub. No.: WO2017/056046
PCT Pub. Date: Apr. 6, 2017

(65) Prior Publication Data

US 2018/0282146 A1 Oct. 4, 2018

(30) Foreign Application Priority Data

Oct. 2, 2015 (IT) ..... 10201557659

(51) Int. Cl.
*G07C 9/00* (2006.01)
*B67D 7/32* (2010.01)
(Continued)

(52) U.S. Cl.
CPC ..... *B67D 7/32* (2013.01); *B67D 7/348* (2013.01); *E05B 47/00* (2013.01);
(Continued)

(58) Field of Classification Search
CPC ..... B67D 7/32; B67D 7/348; G07C 9/00309; G07C 9/00896; G07C 2009/00634;
(Continued)

(56) References Cited

U.S. PATENT DOCUMENTS 6,275,143 B1 8/2001 Stobbe
8,358,232 B2 * 1/2013 Finkenzeller ..... G07C 9/00182 341/176

(Continued)

FOREIGN PATENT DOCUMENTS

DE 102007010896 A1 9/2008
WO 2015128265 A1 9/2015

OTHER PUBLICATIONS

International Search Report dated Feb. 3, 2017; International Application No. PCT/IB2016/055856; International Filing Date Sep. 30, 2016; 5 pages.

(Continued)

*Primary Examiner* — Brian E Miller
(74) *Attorney, Agent, or Firm* — Blank Rome LLP

(57) ABSTRACT

A system includes a valve (14) configured to operate a filling of a tank (11); and blocking device (15) that blocks access to the valve (14). The blocking device (15) is operated between a closing and an opening position by an actuator (20) governed by a wireless terminal (12). The wireless terminal (12) includes a transceiver (65) for sending a charging signal (WD) that includes a data signal portion (D) and a supply portion (W) carrying energy via electromagnetic induction, in particular a WPC (Wireless Power Consortium) signal. The blocking device (15) is configured for receiving electrical energy from the supply portion (W) to operate the actuator (20). The blocking device (15) also includes a control module (70) enabling operation of the actuator (20) according to the data signal portion (D)
(Continued)

exchanged with a corresponding control module (60) of the wireless terminal (12).

20 Claims, 6 Drawing Sheets

(51) Int. Cl.
*E05B 47/00* (2006.01)
*B67D 7/34* (2010.01)

(52) U.S. Cl.
CPC ..... *G07C 9/00309* (2013.01); *G07C 9/00896* (2013.01); *E05B 47/0002* (2013.01); *E05B 2047/0057* (2013.01); *G07C 2009/00634* (2013.01); *G07C 2009/00642* (2013.01)

(58) Field of Classification Search
CPC ..... G07C 2009/00642; G07C 2009/00777; E05B 47/00; E05B 47/0002; E05B 2047/0057; G01F 15/007; G01F 15/005; G08C 17/04
See application file for complete search history.

(56) References Cited

U.S. PATENT DOCUMENTS

| | | | | |
|---|---|---|---|---|
| 9,133,647 | B2 * | 9/2015 | Oh | G07C 9/00309 |
| 9,178,567 | B2 * | 11/2015 | Klein | H04B 5/00 |
| 9,787,137 | B2 * | 10/2017 | Kargl | H02J 5/005 |
| 2007/0176738 | A1 | 8/2007 | Horler | |
| 2007/0179448 | A1 | 8/2007 | Lim et al. | |
| 2011/0247131 | A1 * | 10/2011 | Shi | E03D 9/00 4/223 |
| 2014/0109656 | A1 * | 4/2014 | Tronik | G01N 33/2847 73/53.05 |
| 2014/0110613 | A1 * | 4/2014 | Pitchford | F16K 31/082 251/129.01 |
| 2015/0101370 | A1 | 4/2015 | Russo et al. | |
| 2016/0130130 | A1 * | 5/2016 | Nelson | B67D 7/04 700/283 |

OTHER PUBLICATIONS

Written Opinion dated Feb. 3, 2017; International Application No. PCT/IB2016/055856; International Filing Date Sep. 30, 2016; 7 pages.
English translation; German Application No. 102007010896; Publication Date Sep. 11, 2008; 20 pages.

* cited by examiner

SYSTEM OF PROTECTION FROM UNAUTHORIZED ACCESS TO A VALVE OF A TANK OF FUEL GAS

RELATED APPLICATIONS

This application is a U.S. national phase application of International Application No. PCT/IB2016/055856, filed Sep. 30, 2016; which application claims priority to Italy Application No. 102015000057659, filed Oct. 2, 2015. Each of the above-identified related applications are incorporated by reference.

TECHNICAL FIELD

The present description relates to a system that provides protection from unauthorized access to a valve of a fuel-gas tank, comprising a valve configured for enabling execution of operations of filling of the tank and blocking means that co-operate with said valve for blocking it between a position for closing and a position for opening access to said valve, said blocking means being operated between the closing and opening positions by actuator means supplied with electrical energy, said system comprising a wireless terminal configured for governing said actuator means.

Various embodiments may be applied to a system that provides protection from unauthorized access to a valve of a buried LPG tank.

TECHNOLOGICAL BACKGROUND

In the field of distribution of fuel gas for its various uses, such as heating of environments, cooking of food, or industrial and professional uses, a very widespread solution is to resort, in the case where it is not possible to reach the place of use via the conventional natural-gas pipes, to installation of an LPG (Liquid Petroleum Gas) tank of suitable dimensions for the consumption levels envisaged by the user. The LPG gas tank, which, according to the modalities of installation, may be of an above-ground type or of a buried or underground type, is installed in a suitable position in the proximity of the user system to be supplied.

The gas tank may have a variable capacity roughly of between 1000 and 13000 liters, and in general needs to be refueled with a certain frequency in relation to the consumption levels.

For this purpose, the tank is equipped with a filling valve, in turn provided inside with a suitable non-return device, which prevents, in normal operating conditions, exit of the gas from the tank. The filling valve is opened automatically by the pressure of the LPG entering the tank only during the refueling operations that are performed by means of purposely designed tankers equipped with a pump, a flowmeter, a hose for transfer of the LPG, and a suitable refueling filler to be connected to the filling valve itself. In order to prevent refueling of the tank with gas by non-authorized subjects and other possible tampering, the filling valve is generally protected by a system that prevents access thereto, for example a simple lock or mechanical padlock that prevents connection of the filler.

Known, for example from the document No. DE202007008748, are solutions in which the gas tank is associated to a control module with an electromagnetic actuator that opens and closes the valve of the tank. The control module, via wireless communication with a control terminal, can govern opening of the valve.

The aforesaid system requires a specific electrical supply for operation of the control module and of the electromagnetic actuator. This electrical supply, installed on the filling valve, in the case of use of gases such as LPG, in a potentially explosive environment (ATEX 0) and, in the case of installation on tanks of a buried type, even in an environment that is potentially subject to flooding, is problematical to implement in a wired mode, whereas the use of batteries, in addition to the conditions referred to above (ATEX 0), presents the known drawbacks of limited battery life and reliability.

OBJECT AND SUMMARY

The object of the embodiments described herein is to improve the potential of the methods according to the prior art as discussed previously.

Various embodiments achieve this object thanks to a system that provides protection from unauthorized access to a filling valve of a fuel-gas tank having the characteristics recalled in the ensuing claims. Various embodiments may refer also to corresponding methods that provide protection from unauthorized access to a valve of a fuel-gas tank, as well as to a blocking device designed to operate in the aforesaid system.

The claims form an integral part of the technical teachings provided herein in relation to the invention.

BRIEF DESCRIPTION OF THE DRAWINGS

Various embodiments will now be described, purely by way of example, with reference to annexed drawings, wherein.

DETAILED DESCRIPTION

In the ensuing description numerous specific details are provided in order to enable maximum understanding of the embodiments provided by way of example. The embodiments may be implemented with or without specific details, or else with other methods, components, materials, etc. In other circumstances, well-known structures, materials, or operations are not illustrated or described in detail so that aspects of the embodiments will not be obscured. Reference, in the course of the present description, to "an embodiment" or "one embodiment" means that a particular structure, peculiarity, or characteristic described in connection with the embodiment is comprised in at least one embodiment. Hence, phrases such as "in an embodiment" or "in one embodiment" that may appear in various points in the course of the present description do not necessarily refer to one and the same embodiment. Furthermore, the particular structures, peculiarities, or characteristics may be combined in any convenient way in one or more embodiments.

The references are here provided only for convenience of the reader and do not define the scope or the meaning of the embodiments.

Figure 1:
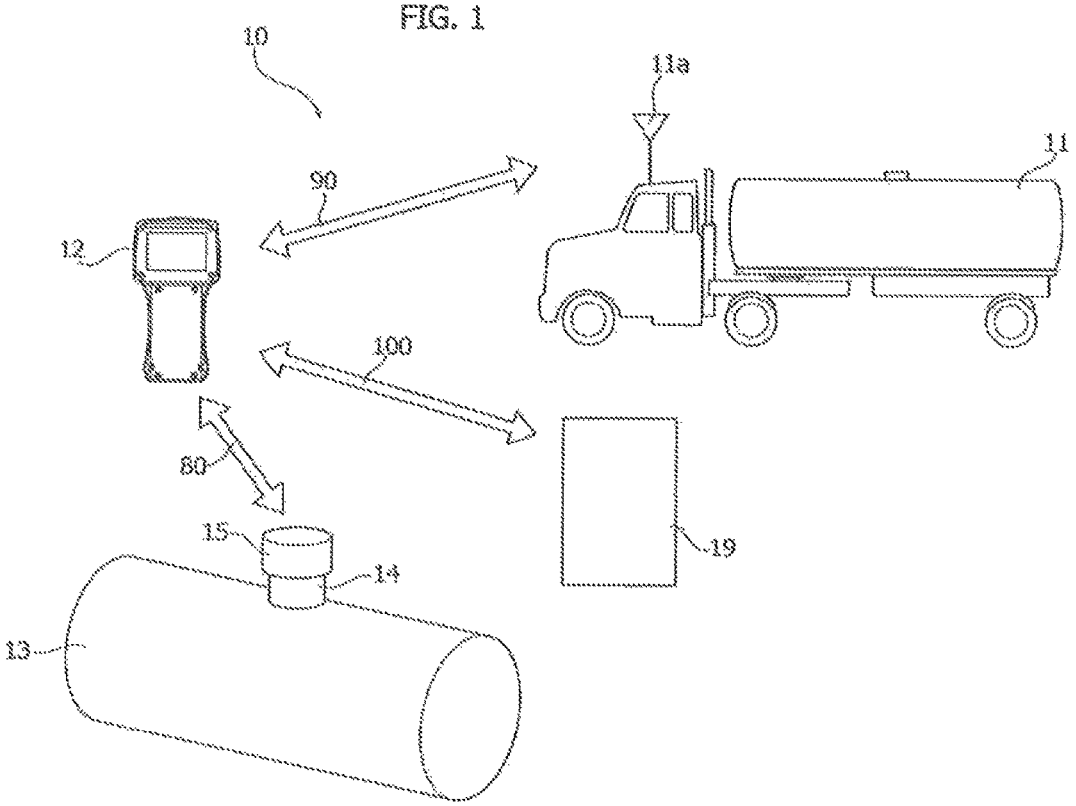
FIG. 1 is a schematic illustration of the system of protection from unauthorized access to a valve of a fuel-gas tank according to the invention.

Illustrated in FIG. 1 is a system 10 that provides protection from unauthorized access to the valve of a gas tank according to the invention.

Designated by the reference number 11 is a tanker that transports gas, in particular LPG.

Designated by the reference 13 is a gas tank, comprising a filling valve 14 to which a blocking device 15 is associated.

Designated by the reference 12 is a communication terminal, which basically comprises a processor and includes communication means designed to communicate over a first wireless communication channel 80 with the blocking device 15, which, as illustrated in what follows, in turn comprises transceiver means. The first wireless communication channel 80 is a channel on which WPC (Wireless Power Consortium) charging signals are exchanged. Furthermore, the communication terminal 12 comprises communication means designed to communicate over a second communication channel 90, for example a Bluetooth channel, with communication means 11*a* associated to the tanker 11.

Figure 2:
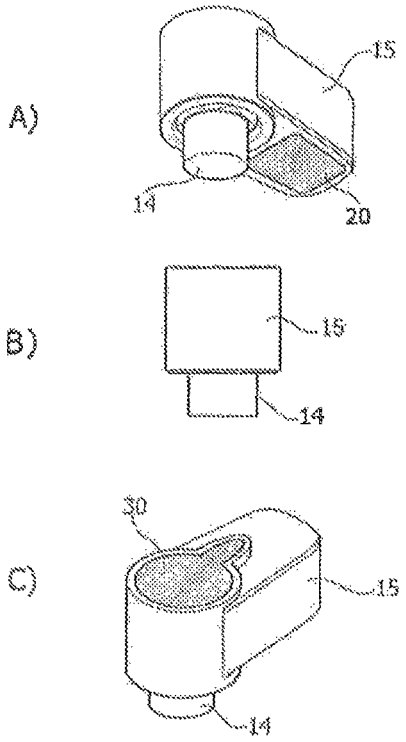
FIGS. 2A-2C show views of blocking means of the system according to the invention.

Illustrated in FIG. 2A is a perspective view from beneath of the blocking device 15, whereas FIG. 2B shows a side view of the blocking device 15, and FIG. 2C shows a perspective view from above.

Figure 3:
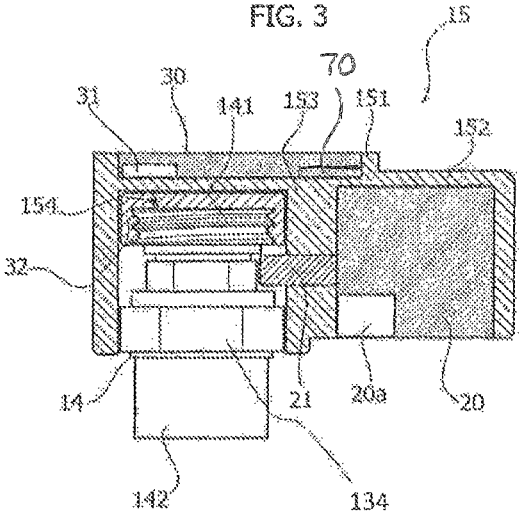
FIG. 3 shows a partial cross-sectional view of the blocking means of the system according to the invention.

Illustrated in FIG. 3 is a lateral section of the blocking device 15.

From the above FIGS. 2A-2C and 3, it may be noted how the blocking device 15 basically comprises a body 151 having a substantially oblong shape that includes an actuator-housing portion 152 and a blocking portion 153, which underneath has a blind hole 154 into which a top inlet portion 141 of a valve 14 is inserted. The aforesaid top inlet portion 141 comprises a threaded end, fastened on which is the refueling filler of the tanker 11 (not illustrated in the figure). The other end 142 of the valve 14 is inserted in a fluid-tight way in the gas tank 13 (not visible in FIG. 3).

The blocking device 15, in the top surface of the blocking portion 153, comprises a control card 30, which is encapsulated in resin. Included in the control card 30 is an electronic control module 70, and also included is a sensor 31 for detecting the position of the valve 14. Designated by 32 is a valve-protection cap, set at the bottom of the blind hole 154, which protects the end 142 of the valve 14.

Set in the actuator-housing part 152 is an actuator 20, of an electromechanical type, which moves in a direction orthogonal to the longitudinal axis, vertical in the figure, of the valve 14 a blocking pin 21. The blocking pin 21, which slides in a fluid-tight way in the body 151, is operated by the actuator 20, when it is required to block the valve 14, in a horizontal direction, towards the valve 14, so as to engage a groove underneath the threaded end 141 of the open-close element 14 and to block the blocking device 15 on the valve 14, thus preventing access to the end 141 and consequently the possibility of inserting the filler on the valve 14, so preventing non-authorized staff who are not able to remove the blocking device 15 from possibly refueling the gas tank.

The mechanical blocking system, according to the type of valve, may be:

- direct, hence acting directly on the body valve, typically via a pin 21, as in the example of FIG. 3, or a blocking tooth;
- indirect, acting on a second mechanical device, typically a blocking pin, that the operator must extract or insert by hand for releasing/blocking the blocking device 15.

The actuator-housing compartment 152 within the blocking device 15, where the actuator 20 with the blocking pin 21 is installed, has an opening 16 towards the outside (visible in FIG. 2A) to enable installation of the components such as the actuator 20. The opening 16 is then sealed with epoxy resin. To increase protection from burglary, the opening 16 faces downwards so as to be inaccessible to the blocking device 15 mounted on the tank 13.

The blocking device 15 comprises the body 151, which is substantially a metal lid made of aluminium, or in any case of any other high-strength anti-static material, that can be applied on the valve 14 for loading the tank 13 to prevent access thereto.

The blocking pin 21 mechanically maintains the position assumed, after the action of the electromagnet of the actuator 20 ceases, without any need for further energy (and hence for contact with the terminal 12), thus implementing an automatic bi-stable operation. Alternatively, the blocking device 15 on the valve may be obtained with a pin that can be manually inserted, which is in turn blocked in position by the pin 21 governed by the electromagnet of the actuator 20, thus obtaining a manual bi-stable operation. The position of the blocking pin (extracted/retracted) is checked via the electronic sensors 20*a* inside the blocking device 15. In addition, once again via electronic sensors 31 within the blocking device 15, it is possible to verify whether, at the moment of release of the pin 21, the blocking device 15 is positioned on the valve. Through a cross-comparison of the above data it is possible to validate the release operation, verifying whether it has been performed for de-activating or activating the blocking device 15, or else if it has been performed with an empty tank, for testing purposes or in an attempt at tampering.

The energy necessary for operation of the blocking device 15 is supplied only by the terminal 12 via inductive coupling obtained with implementation of the QI-WPC standard for wireless recharging. Hence, the blocking device 15, in the absence of excitation by the terminal 12, is totally inactive and without energy. In this way, advantageously no periodic maintenance is required; moreover, the entire electronic part of the blocking device 15 can be sealed by being encapsulated in resin, enabling operation thereof in ATEX-0 environments.

Figure 4:
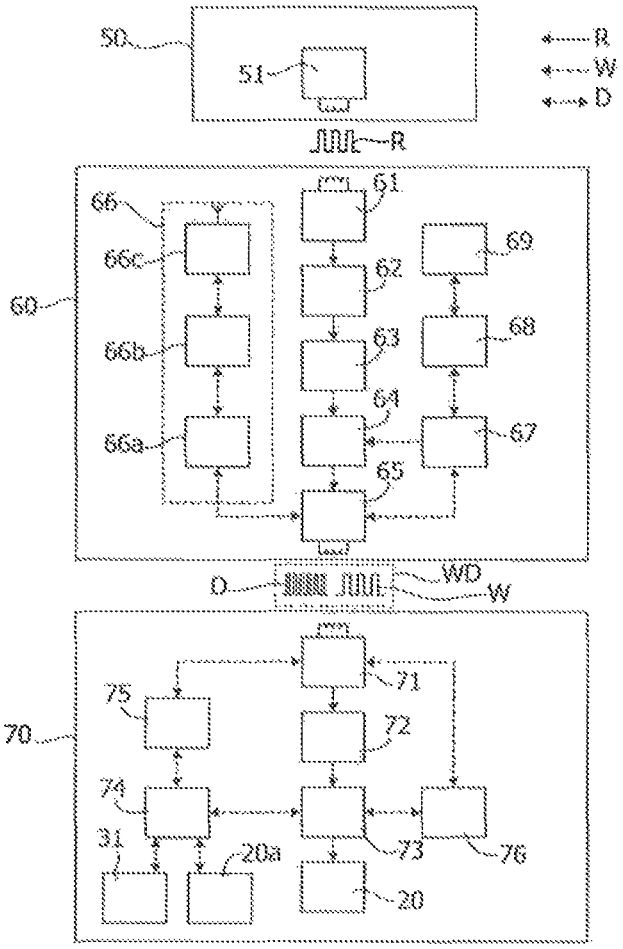
FIG. 4 shows a block diagram that illustrates functional modules of electronic modules of the system according to the invention.

Illustrated in FIG. 4 is a block diagram representing the functional signal and supply modules of the system 10 and their operation.

In FIG. 4 the dark thick arrow indicates a recharging signal R, the lighter thick arrow indicates a supply signal W, and the thinner arrow indicates the data signal D. These signals will be more fully described in what follows with reference to FIG. 4.

Figure 5:
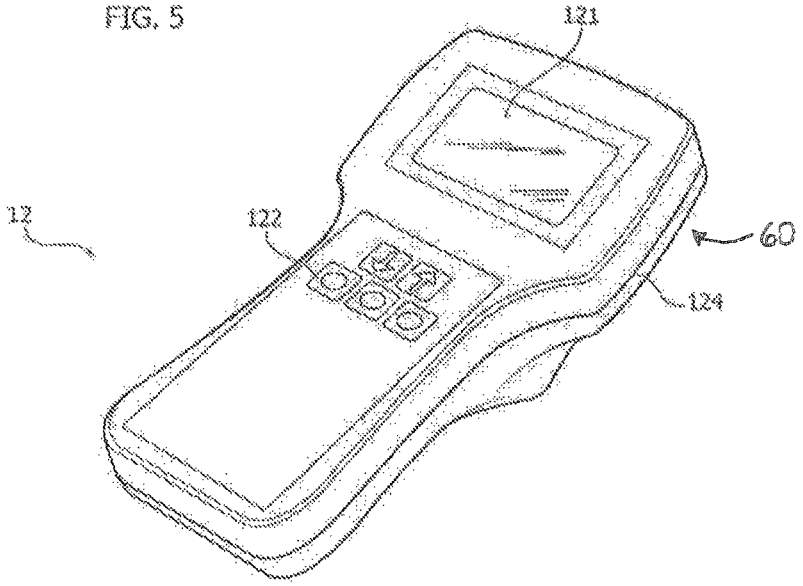
FIG. 5 shows a perspective schematic view of a communication terminal of the system according to the invention.

The blocking device 15 comprises an electronic module 70, set in the card 30 (as shown in FIGS. 2C and 3). The electronic module 70 (as shown in FIG. 4) includes a transceiver 71 of WPC (Wireless Power Consortium) charging signals. The aforesaid transceiver 71 basically provides, with a corresponding transceiver 65, the second communication channel 80 of FIG. 1. Via the transceiver 71 the blocking device 15 receives the energy necessary for activation and operation. Furthermore, via the transceiver 71 of WPC charging signals the blocking device 15 is able to set up a bidirectional link over the first channel 80 for data exchange with a control module 60 comprised in the terminal 12 (as shown in FIG. 5). The WPC signal comprises in fact a bidirectional data link D and a supply portion W, carrying energy emitted via electromagnetic induction, is designated as a whole by WD and illustrated in FIG. 4, and is transmitted from a transceiver 65 in the control module 60 to the transceiver 71 in the module 70.

The data signals D exchanged between the transceivers WPC comprise information regarding:

cryptographic check of authorization of the control module 60 to govern the actuator 20 (after sending of an encryption key K from the terminal 12 to the blocking device 15, as described further hereinafter); and position and status of the valve-blocking device (blocked, released, breakdown condition, etc.).

The control module 60 sends the energy received to a supply unit 72, which manages and converts the energy received for:

supplying the electronics of the blocking device 15, via filters and voltage converters;

supplying the electromechanical blocking actuator 20, via voltage converters and energy-storage devices for compensation of the transients.

Furthermore, an encryption unit 76 is shown, in signal relation with the module 60, i.e., in relation of exchange of the data D, this unit being responsible for cryptographic check of authorization of the control module 60 of the terminal 12 to govern the blocking device 15. If this check yields a positive result, the encryption unit 76 enables a switching unit 73 so as to allow activation of the actuator 20 that carries out blocking of the valve 14. Hence, the blocking device 15 accepts and executes the command requested by the controller 60 only after the latter has passed the cryptographic check.

The aforementioned switching unit 73 comprises a solid-state device, which manages, via PWM (Pulse Width Modulation) or ON/OFF signals, the electromechanical blocking actuator 20. The switching unit 73 receives the command issued by the control module 60 via the data D, through the control module 70, but executes it only after receiving consent from the encryption unit 76 and from a position-verification unit 74. The switching unit 73 manages movement of the actuator 20 also on the basis of a position feedback that it receives from the position-verification unit 74.

The actuator 20 is the electromechanical actuator that moves the mechanical blocking system, via which the blocking device is blocked on the valve 14 or is released and removed. The actuator 20, according to the type of valve, may be a simple solenoid (ON/OFF control), or else an electric motor controlled in PWM by the unit 73.

The control module 70 also comprises the valve-position sensor 31, which is a sensor of an inductive (or capacitive) type that is able to detect whether the blocking device 15 is positioned on the valve. Only in this circumstance is it possible to operate the blocking device 15, this in order to prevent false positives, such as in the case where the blocking device 15 is blocked without being effectively fitted on the valve 14: the tank 13 appears to be protected, while in actual fact it is not.

The control module 70 also comprises a sensor of blocking position 20*a*, i.e., a sensor of an inductive (or capacitive, or magnetic) type, which is able to read the position of the mechanical blocking performed by the actuator 20.

The position-detection unit 74 is the unit responsible for management and reading of the position sensors 31 and 20*a* and issues a consent for actuation of the switching unit 73 only if the blocking device 15 is positioned on the valve 14 (sensor 31) and if the blocking command (sensor 20*a*) has not already been executed. The position-detection unit 74 is in a relation of bidirectional data-signal exchange with a feedback unit 75, which is the unit that receives the data regarding the status of the blocking device from the aforesaid unit 74, processes them, and transmits them via the WPC transceiver 71 to the control module 60 of the terminal 12.

FIG. 4 represents the functional modules of the module 70 that are implemented in a hardware of the blocking device 15, comprising, for example, a microprocessor, which preferably implements the operations regarding the encryption unit 76 and/or the switching unit 73 and/or the feedback unit 75. The electronic module 70 preferably further comprises a permanent-memory module, for storing the encryption key K and the latest numeric values used for authorization of the terminal 12. Furthermore, the blocking device 15 at the hardware level, in addition to the electronic sensor 31 for proximity detection of the valve and to the electronic sensor 20*a* for detection of the position of the blocking pin, also preferably comprises a UID (electronic serial number) module for unique identification of each blocking device 15, a temperature sensor, and the actuator 20.

Once again with reference to FIG. 4, the control module 60 of the terminal 12 in turn comprises the following functional modules.

In the first place, the control module 60 comprises the aforementioned charging transceiver 65 with WPC standard, via which the control module 60 supplies to the blocking device 15 the energy necessary for activation and operation. Using the same WPC charging transceiver 65, the control module 60 is able to establish a bidirectional link for exchange of data D with the blocking device 15.

Also the control module 60 then comprises a respective switching unit 64, which is the unit responsible for activating the WPC charging transceiver 65 with the battery energy, when the operator requests, by acting on the terminal 12, blocking/release of the blocking device 15.

The same energy is initially necessary for activating the cryptographic check, by the blocking device 15, of authorization of the control module 60 to carry out release.

The control module 60 comprises in this regard a respective encryption unit 67, which is the unit responsible for cryptographic processing of the response to the blocking device 15, after the request by the latter for validation of the authorization by the control module 60. Only if the response is accepted and validated by the blocking device 15, via its own encryption unit 76, is the blocking/release command requested by the operator via the terminal 12 to the respective control module 60 executed.

The control module 60 further comprises a feedback module 66, which includes a feedback unit 66*a*, responsible for receiving status information from the blocking device 15 and from the control module 60 itself. This information is then processed and passed on to a data-transfer unit 66*b* in the aforesaid feedback module 66, which is configured for managing data communication with a remote server 19 (shown in FIG. 1), for example, owned by the gas-supply company, through a custom implementation of the MQTT protocol.

Communication with the remote server 19 takes place over a third communication channel 100, for example a 3G mobile communication network, and is bidirectional:

the unit 66*b* transmits to the remote server 19, via a wireless modem 66C designed to transmit over the third communication channel 100 all the information regarding any operation of blocking/release on the blocking device 15; if the 3G link over the channel 100 is not currently available, the information is stored in the control module 60, until the link is again established; and the unit 66*b* periodically receives from the remote server 19 the information regarding the authorization by the control module 60, i.e., the encryption key K, and corresponding cryptographic validation with the blocking device 15.

The remote server 19 can also disable permanently the control module 60 through the communication channel 100, in the case of theft or improper use.

Moreover illustrated in the control module 60, in signal-exchange relation with the encryption unit 67, is a user-interface unit 68, which is configured for managing the user interface of the control module 60, through the graphics displayed on a display 121 of the user terminal 12, illustrated in FIG. 5, and for managing the user commands received from a touch screen, on the aforesaid display 121, and from the keypad 122. The display 121 is, for example, a waterproof alphanumeric display, used for acknowledgement and status messages, whereas the keypad 122 is a waterproof membrane keypad, for activation of the functions, entering of the operator codes, and initial configuration. In variant embodiments, the display 121 may be graphic, in particular of a touchscreen type, and used for the operator codes, whereas the keypad is limited to the main functions. More in general, the operator codes are entered via the ensemble made up of the touchscreen and the keypad.

Designated by 69 is, instead, the module including the display 121 and the keypad 122, which constitutes the effective user interface of the control module 60 in the terminal 12 and comprises, also with reference to FIG. 5, as has been mentioned, a touchscreen and a membrane keypad, which are integrated in a container housing 124, without prejudice to fluid tightness and anti-static features thereof.

Designated by 63 is a battery internal to the control module 60, for example of the lithium-ion type, which is rechargeable and completely encapsulated in protective resin (EX-MA) adequate for use in ATEX-0 environments. Designated by 62 is a corresponding battery-charger module configured for managing recharging of the internal battery 63 of the control module 60, controlling the voltage and current thereof. The aforesaid battery-charger module 62 is directly supplied by the output of a WPC receiver 61, which is configured for interacting with an external battery charger 50.

The aforesaid external battery charger 50 is a module separate from the terminal 12, which in turn comprises a WPC transmitter 51 for sending a recharging signal R (similar to the charging signal WD). The battery charger 50 is configured so as to be activated automatically when the terminal 12 is rested thereon. The WPC transmitter is hence preferably housed in a plastic container of the external battery charger 50, of small dimensions, to be rested on the terminal 12 until charging is complete. The external battery charger 50 may be equipped with a magnetic system for centring on the corresponding recharging area, corresponding to the transceiver 61, on the terminal 12. The battery charger 50 further comprises, for example, a USB socket, for 5-V/5-W supply from the electric-power mains or for 12/24-V supply (for example, available on the tanker 11), as well as a 230-V power supply with USB connector for the recharging module, to be used for recharging from the electric-power mains. Thanks to wireless recharging via the battery charger 50, advantageously the terminal 12 does not require connectors towards the outside, and hence all the internal electronics can be encapsulated in resin (protection EX-MA) so as to enable its use in ATEX-0 environments.

Hence, on the basis of what has been described so far, a method for access to a valve of a fuel-gas tank via the access system 10 comprises the operations of applying the terminal 12 in contact with the blocking means 15, supplying a charging signal WD to the aforesaid blocking means 15, the signal comprising a supply portion W, and exchanging with the aforesaid blocking means 15 a sequence of commands via the data signal portion D, the sequence comprising a command for blocking or releasing the aforesaid blocking means 15.

Figure 6:
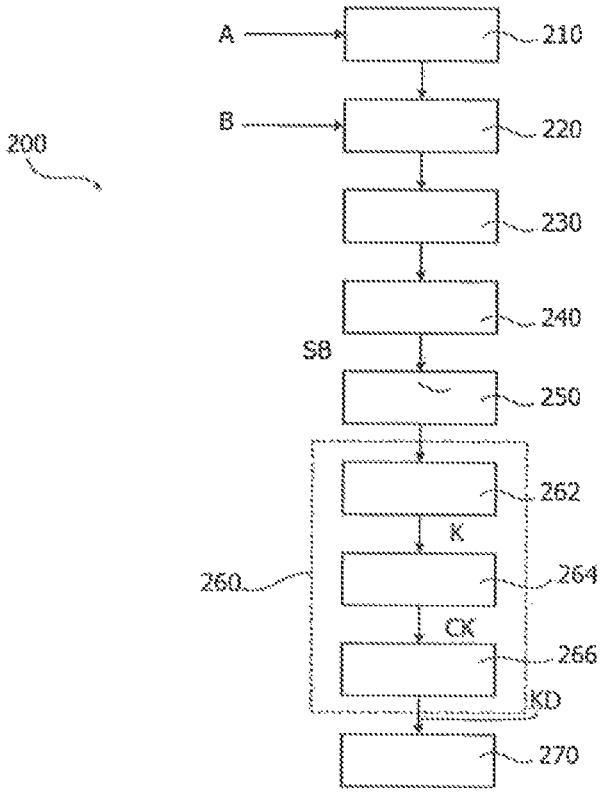
FIG. 6 shows a flowchart illustrating operations performed by the system according to the invention.

There now follows a description, with reference to the flowchart of FIG. 6, of a procedure 200 of authorization for access to the valve 15 carried out through the terminal 12, via interaction between the control module 60 of the terminal 12 and the electronic module 70 of the blocking device 15.

In the first place, there are envisaged steps (210-230) of a sub-procedure 200 for protected activation of the terminal 12 for carrying out the operation of blocking or release of the valve (i.e., blocking or release via movement of the pin 21), which comprises:

activation 210 in the terminal 12 of the valve-blocking/release operation or mode by entering a valid activation code A into the terminal 12;

execution 220 of an optional step for verifying the presence of the tanker 11; and following upon step 210 or the optional step 220, entry 230 of the terminal 12 into the mode for blocking/release of the blocking device 15; this mode remains active for a given length time, sufficient for carrying out gas refueling.

In greater detail, as regards steps 210-230, following upon which the operator can activate the terminal 12 for carrying out a release operation, i.e., an operation that interacts with the blocking device 15 for enabling its removal and hence access to the valve 14:

the step 210 of activation of release envisages entering by the operator a valid activation code A; for this activation code A to be valid, it must be identical to one of a plurality of codes downloaded from the company server 19 and stored in a configuration step (protected by password) on the terminal 12; in this way, the identity of the operator is checked;

the step 220 of execution of a step of verification of the presence of the tanker 11 envisages acceptance by the terminal 12 of the activation code entered by the operator only upon reception of a valid tanker-identifier code B from the Bluetooth unit 11*a* already installed as standard equipment in the cab of the tanker 11: the Bluetooth unit 11*a* supplies a safe identifier, which is agreed upon previously and must preferably be implemented in a control module already installed in the tanker 11; this tanker control module is a module that is used by the operator for printing the delivery note and for transmitting the fuel-delivery data to the company server 19; in variant embodiments, the Bluetooth unit 11*a* may be a Bluetooth module specifically installed on the tanker 11 for identification; in this way, the terminal 12 can be activated for carrying out the release operation only on board or in the proximity of an authorized tanker; if each tanker 11 can supply a unique identifier B via Bluetooth 11*a*, then it will be possible to combine each terminal 12 to one or more pre-defined tankers 11; this step of verification of the presence of the tankers is in general optional, or else there may be implemented the possibility, for authorized users (staff responsible for assistance or safety) to bypass the Bluetooth verification, after prior entry of an expressly provided bypass code: in this way, it is possible to activate the terminal 12 in release mode even in the absence of the tanker 11;

entry 230 of the terminal 12 into the release/blocking mode, in which it is possible to govern the operation of release or blocking of the device 15, thus enabling access to the valve 14, is such that the terminal 12 remains activated in release mode for a limited period of time, sufficient to complete the operation of gas refueling; upon expiry of the aforesaid given time, the terminal 12 exits automatically from the release/blocking mode (and hence can no longer act on the blocking device 15); to reactivate this mode, the operator must re-enter within the range of the communication channel 90, Bluetooth, of the tanker 11.

After entry of the terminal 12 into the blocking/release mode 230, in a step 240, the operator can then send a release or blocking command SB via the terminal 12 to the blocking device 15 over the channel 80 in the data portion D of the WPC signal WD.

When, in a step 250, the blocking device 15 detects in the data D a release/blocking command SB sent by the control module 60 of the terminal 12, before executing this command, it carries out a step 260 of verification of authorization of the terminal 12, via the following procedure:

the blocking device 15 sends, in a step 262, to the terminal 12 a value of encryption key K, in particular 256 bits long, with encoding of an AES (Advanced Encryption Standard) type or some other high-level standard cryptographic protection, such as SHA-256 (Secure Hash Algorithm), via a numeric key stored in the firmware, i.e., in the module 70, specifically in the encryption unit 73 of the blocking device 15 itself; the list of the keys stored in the various blocking devices 15 constitutes confidential information, to be protected and stored, for example, in the company server 19 and access to which is to be granted only to the staff appointed for safety; the value of the 128-bit encryption key K is a number generated each time randomly by the blocking device 15, and hence always different at each new command; moreover, the blocking device 15 checks that it is always different from the last values generated;

in addition, the blocking device 15, in a next step 264, sends a numeric value in the clear CK, which identifies the type of key used; this makes it possible to operate with one and the same terminal 12 on devices 15 having different keys stored in their firmware; the key K of the blocking device 15 is stored in the production stage and can no longer be changed in any way after the blocking device 15 has been sealed;

the terminal 12, in a step 266, decodes the value of the key K received, and sends it in response to the blocking device 15 as decoded key KD: the returned value KD is correct only if the terminal 12 knows the decoding key stored in the blocking device 15.

The terminal 12 chooses the decoding key to be applied, on the basis of the type CK declared by the blocking device 15, from an internal list, which is constantly updated remotely by the company server 19. In this way, each authorized terminal 12 is able to operate on any blocking device 15. The blocking device 15 accepts and executes the blocking/release command in a step 270 only if it receives in step 266 a value of decoded key KD correctly decoded.

The firmware stored in the microprocessors of the blocking device 15 and of the terminal 12 is protected from reading and decoding. In this way, it will be impossible for non-authorized persons, even if they enter into possession of a blocking device 15 or terminal 12 and manage to take it apart without damaging it (the microprocessors are encapsulated in epoxy resin), to read the firmware, the procedures, and the encryption keys contained therein.

In the framework of the procedure 200, the terminal 12 moreover implements a protection against use by non-authorized staff possibly possessing a terminal 12 already enabled with a valid activation code A. The terminal 12, on the basis of its own internal clock (synchronized, for example, through the Internet via the channel 100, for example via the 3G mobile communication network, autonomously at the end of each day e.g., at 23.30) immediately before automatic turning-off irreversibly erases all the encryption keys stored, and thus becomes unusable for opening the blocking device 15. The terminal 12 downloads from the company server 19 and stores the encryption keys once again only after it has been switched back on and after it has been enabled by the operator with a valid activation code. This implies that entry of the operator code (an operation that is typically to be made at the start of each day) must be made with the terminal 12 under 3G/GPRS coverage. In this way, even if a terminal 12 were stolen from the operator after he had activated it with his own activation code, it would be able to release one or more devices 15 only until the end of the day and then would become unusable.

Hence, the blocking device 15 can be inserted into or removed from the valve 14 only through the use of the terminal 12, after prior correct activation thereof, with the terminal 12 resting on the surface of the blocking device 15 itself. This operation is not allowed for non-authorized staff, via electronic encryption: no physical key is hence necessary.

At the end of each release operation 270 the blocking device 15 transmits via the transceiver 71 to the terminal 12 status information, which comprises:

position of the blocking pin 21 (extracted/retracted);

position blocking device 15 on the valve (yes/no);

temperature;

UID number (unique serial number, identifying each blocking device 15); and count of the number of openings and closings performed on the blocking device 15, from entry into service of the system.

The terminal 12, via its own control module 60, as illustrated with reference to FIG. 6, is configured for carrying out activation of the operation of blocking/release of the blocking device 15 only after validation of the operator code (step 210) and possibly of the presence of tankers (step 220).

The terminal 12 is moreover configured for carrying out this operation of release of the blocking device 15 via contact wireless connection (for power supply and data exchange), after prior authentication.

The terminal 12 is moreover configured for carrying out reading and storing of the data (possibly including temperature) supplied by the sensors of the blocking device 15 conveyed through the feedback unit 75 and the WPC transceiver 71.

The terminal 12 is hence configured for carrying out validation of the operation of release of the blocking device 15 on the basis of the aforesaid sensor data (blocking device 15 on the valve, position of the blocking pin).

The terminal 12 is moreover configured for carrying out a geo-location, via a GPS module, included in the terminal 12, but not illustrated in the figures, of the release operation.

The terminal 12 is moreover configured for carrying out an image acquisition via a photographic camera and an incorporated flash, with automatic transfer of the images on the remote company server 19 (for example, via FTP).

The terminal 12 is moreover configured for carrying out a real-time transfer, via protected 3G/GPRS connection (HTTPS) of the data of the release operation to the company server 19. In the absence of network coverage, the terminal 12 is moreover configured for carrying out an internal storage of the data of the release operations, which will then be downloaded onto the company server 19 when the network coverage is restored.

The terminal 12 is moreover configured for carrying out updating of the configuration parameters (operator codes, electronic keys, etc.) from the company server 19, via protected 3G/GPRS connection (HTTPS).

The terminal 12 is moreover configured for carrying out deactivation of all the functions and erasure of internal memories upon command received from the company server 19, in the case of theft or irregularities, via a protected 3G/GPRS connection (HTTPS).

The terminal 12 is moreover configured for carrying out a display of the status and acknowledgement messages to the operator, on the incorporated display 121.

The terminal 12 is moreover configured for managing automatic wireless recharging of the internal battery 63, via the battery charger 62, when the terminal 12 is associated to the external WPC battery charger 50.

The case 124 of the terminal 12, illustrated in FIG. 5, is preferably waterproof, certified ATEX 1-2, made of anti-static plastic material (resistance$<10^9\Omega$) to prevent formation of static electricity, thus eliminating the possibility of sparks. The terminal 12, in addition to an ergonomic shape, preferably has a useful surface sufficient to house a display 121, a keypad 122, and a WPC coil (for recharging the wireless module 61 and governing the blocking device 15).

Inside the case of the terminal 12, all the circuitry that cannot be considered intrinsically safe, such as the motherboard, the battery, or other components, is encapsulated in epoxy resin in a bottom half-shell of the case 124 of the terminal 12, so that it is able to operate also in ATEX-0 environments. The terminal 12 preferably does not have any type of connector in order not to limit use in ATEX-0 condition. Interaction with the operator takes place, in fact, via the incorporated keypad 122 and display 121, whereas the data connections D with the blocking device 15, with the control unit of the tanker 11, and with the company server 19 are all obtained over wireless channels, as also battery recharging is carried out in a wireless way.

As has been said, the terminal 12 is moreover configured for carrying out an image acquisition via photographic camera. The aforesaid camera is preferably a digital camera with LED flash to enable the operator to document any possible attempts at tampering detected on the tank and corresponding accessories (valves, etc.). The images are then transferred automatically, at the end of the day and via 3G connection, onto the company server 19. For use with the camera, the display 121 is preferably of a TFT graphic type so as to operate also as viewfinder of the camera and as display for viewing the shots. The microprocessor and the memory of the terminal 12 are also sized in terms of computing power and capacity so as to be adequate for graphic management and for storing an adequate number of shots. The keypad 121 can be configured with keys suitable to enable the operator to carry out the basic functions envisaged (photographing, display of images, etc.) by the camera. To be able to store the commands for these functions, it is possible to use the same keys envisaged for the other functions, implementing a dual function, or else the touchscreen. The terminal 12 may comprise a firmware module for deferred transfer of images via FTP onto the company server, additional to the real-time MQTT communication implemented for the other functions.

To sum up, the terminal 12, in a possible configuration, comprises the following hardware components:

a membrane keypad 122, for local communication with the operator;

a graphic display 121, for enabling local communication with the operator and use of the possible incorporated digital camera;

a microprocessor for implementing all or part of the functions of the control module 60 described with reference to FIG. 4;

a GPS module, for geo-location of the operations;

a digital-camera module with flash, for image acquisition;

a Bluetooth module for communication over the communication channel 90 with the control unit of the tanker 11;

a 3G-GPRS module with SIM, for data communication over the channel 100 with the company server 19;

a wireless supply and communication module with the blocking device 15, comprising the WPC transceiver 65;

a UID (electronic serial number) module for unique identification of each terminal 12;

a permanent-memory module for storing the operating and configuration parameters, accessible locally and from the company server;

an RTC (Real-Time Clock) module for provided date and time, automatically synchronized through the Internet over the channel 100;

an internal-supply module, comprising a battery 63, for example a rechargeable lithium battery, a wireless recharging unit (module 61), a counter for displaying in percentage terms the state of battery charge.

All the release/blocking operations 270 and the corresponding data (date, time, validation, operator code, geo-location, etc.) are transferred in real time, via 3G/GPRS connection, from the terminal 12 to the company server 19.

Connection to the company server 19 is protected (HTTPS protocol) and is obtained on MQTT protocol, for reducing to a minimum the amount of data transmitted and enabling transfer thereof even in non-optimal conditions of network coverage (GPRS). Hence, installed in the company server 19 is a program that operates as MQTT server.

Via the digital camera integrated in the terminal 12 the operator will be able to document any possible tampering with the tank and the corresponding equipment (safety valves, etc.) that were to be found at the moment of refueling, or on other occasions of inspection. The photographs taken will be stored locally by the terminal 12, which will then transfer them onto the company server at end of the day, before automatic turning-off, if an optimal condition of network coverage (3G) is available; otherwise, transfer will be put off to the moment when the 3G connection is again available.

Since the files of the images are much heavier than the descriptive strings of the release operations, transfer onto the company server 19 is carried out via the FTP, available on the server 19 as confidential FTP access, protected with access codes. The images are accompanied by the information necessary to correlate them with the specific tank 13 and the refueling operation where they have been taken, namely, for example:

GPS geo-location;
date and time; and
operator code.

Illustrated in greater detail in what follows are some aspects of the blocking device 15.

Figure 7:
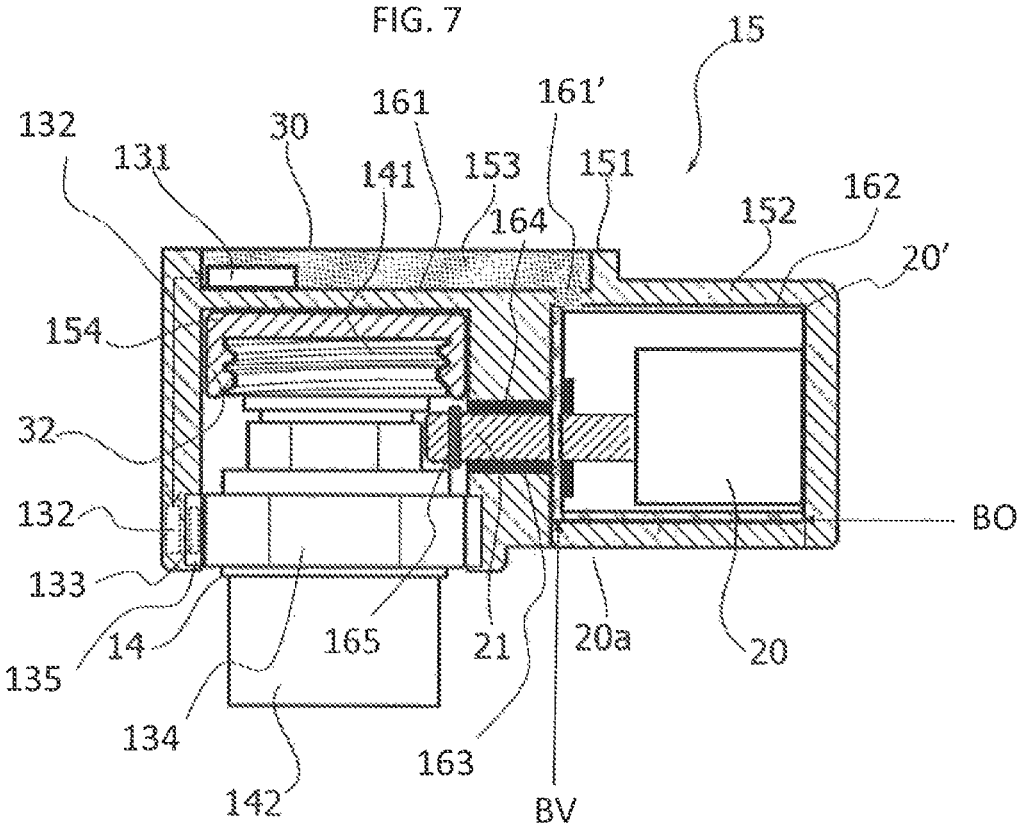
FIG. 7 shows a side view in partial cross section of a variant embodiment of the blocking means of the system according to the invention

FIG. 7 shows a side view, similar to that of FIG. 3, of a variant embodiment of the blocking device 15, in which the electronic card 30 lies in an electronic housing 161 that forms a chamber completely filled with resin. The chamber 161 of the electronic housing communicates with the actuator housing 152 only by means of a hollow passage 161', which is also, however, sealed by the resin that fills the electronic housing 161.

In this variant embodiment, a chamber 162 of the portion 152 houses the actuator 20, which actuates the pin 21. The actuator 20 is located in a box-like container 20'. In other words, in this case, as compared to the embodiment of FIG. 3, there is not a chamber open downwards with the entire actuator 20 embedded in resin to obtain waterproofing, but rather a closed chamber, namely, the chamber 162 in which the container 20' of the actuator 20 is set, without this chamber being filled with resin. The volume of the chamber is, however, reduced to a minimum, with a specific design, so as to remain below the maximum limits prescribed by the ATEX-0 standard for non-encapsulated cavities.

This solution is particularly suitable in the case where the actuator 20 is of the type with d.c. electric motor, whereas the embodiment where the actuator is embedded in resin is more suitable for electromagnetic solenoid actuators.

The chamber 162 of the actuator-housing portion 152 is moreover then completely sealed with respect to the outside in so far as along the entire contrast profile where the container 20' of the actuator 20 bears upon the chamber 162 of the electronic housing 161, which is closed by the actuator itself, a hermetic seal 163 is applied, made, for example, of cyanoacrylate sealing adhesive.

Along the horizontal contrast profile BO where the aforesaid container 20' bears upon the chamber 162, on which screws for fastening the actuator 20 (not illustrated) to the portion 152 act by pressure, no gap is envisaged, but only a machining tolerance, for example of 0.05 mm. In this way the seal, under the pressure of the screws, will fill any space or irregularity between the surfaces. Along the vertical contrast surface, on which it is not possible to exert pressure with screws, a gap of 0.1 mm between the surfaces is provided. In this way, the sealant 163 (which, as per specifications, guarantees tightness on gaps of up to 0.25 mm) forms an elastic bead, which guarantees not only tightness but also permanent gluing.

The blocking pin 21, operated by the electromechanical actuator 20, slides in a cavity 164 made in the body 151. The cavity 164 is covered with a bushing 165 made of self-lubricating material, which allows a maximum gap, in particular of 0.083 m, between the inner wall of the bushing and the surface of the pin 21 sufficient to meet the ATEX-0 specifications for sliding pins (0.3 mm—FLAMEPROOF protection—TABLE 2 of IEC 60079-1).

However, both to maximize the ATEX protection and to guarantee underwater tightness of the blocking device 15, also sealing of the sliding pin 21 is envisaged, obtained with a double-lip seal 165 located between the pin 21 and the sliding cavity 251, after the bushing, towards the outside.

It is emphasized how the aforesaid double-lip seal 165, even though commercially available, operates in a cavity specifically configured as regards shape and size to determine a tightness of the seal of up to 0.1 bar, hence within the design specifications, without overloading the actuator 20 during movement of the pin 21.

Sealing solutions are applied also to the communication terminal 12, which may have two configurations:

integrated, hence configured as palmtop device that integrates all the functions of control and wireless supply of the blocking device 15, communication with the remote server 19, and operator interface; and separate, the terminal 12 of which is substantially a module corresponding to the control module 60 to be rested on the device 15, and equipped with a wireless transceiver, in particular Bluetooth, for communicating with an ATEX-1 smartphone.

In this case, the terminal 12 implements only the functions of control and wireless supply of the device 15, plus the functions of Bluetooth communication with the smartphone. The smartphone (which may be only of ATEX-1 class, given that it does not have to be inserted into the sump of the tank) communicates via Bluetooth with the control module 60 and implements the functions of communication with the remote server 19 and with the operator interface.

In both configurations, the terminal 12 is equipped only via electronic devices (i.e., for example, not electromechanical devices) operating at an intrinsically safe voltage (for example, 5 V). It is hence sealed by being totally encapsulated in epoxy resin (protection of an ENCAPSULATION type for the ATEX standard).

Encapsulation implies that the terminal 12 is able to perform all its functions without any need for any physical connection, either for the data or for recharging the internal battery (which is also performed in wireless mode via WPC signals).

The blocking device 15, in a further variant embodiment, implements as actuator 20 a servomotor with position feedback for the movement of the pin 21.

Among the advantages of the aforesaid solution there is also the possibility of managing profiles of movement of the pin 21.

In the even of a possible layer of dry mud around the pin, in the case where the sump of the tank 13, in which normally the valve 14 and other actuators are present, were to remain flooded for a long time by muddy water, the sediment of mud could hinder movement of the pin 21. It is hence envisaged that the blocking device 15 can be controlled for carrying out a specific profile of movement of the pin 21, via corresponding PWM (Pulse Width Modulation) driving of the servomotor, such that the actuator 20 impresses on the pin a vibrational movement, before passing into a blocking or release position. The aforesaid profile may correspond, for example, to governing a to-and-fro movement of the pin 21 with a stroke of 1 mm at a frequency of 5 Hz. This vibrational movement enables release of the constraint deriving from the mud, albeit remaining within the maximum force that can be exerted by the servomotor. Once this constraint has been removed, the pin 21 can perform normally the complete stroke envisaged for blocking/release.

Furthermore, in variant embodiments, there is envisaged the use of a sensor for detecting the current absorbed by the servomotor of the actuator 20 so as to detect anomalies of sliding or jamming of the pin 21 (which automatically reflects in a variation of the load on the servomotor and hence of the current absorbed thereby).

The value of current absorbed for each movement is communicated in real time to the central server 19, where it is used for predictive maintenance of the blocking device 15. According to what has been indicated previously, via electronic sensors 31 within the blocking device 15, it is possible to verify whether, at the moment of release of the pin 21, the blocking device 15 is positioned on the valve. Through a cross-comparison of these data, it is possible to validate the release operation, verifying whether it has been performed for de-activating or activating the blocking device 15, or else if it has been performed with an empty tank, for testing purposes or in an attempt at tampering.

In variant embodiments, it is envisaged to enable the blocking device 15 to recognize the specific valve of the tank 13 on which it is mounted and access to which for refueling is to be protected. This object is obtained by incorporating an RFID (Radio-Frequency IDentification) tag in the valve of the tank, which carries a unique identifier number (UID).

The blocking device 15 is configured for accepting a blocking or release command only if, via an RFID reader of its own, it manages to read an RFID tag, and is hence positioned on a tank valve, and, if this unique identifier number (UID) corresponds to an identifier recorded in its own memory, this is an index of the fact that the blocking device 15 is positioned on its own specific tank 13.

In this way, the blocking device 15 does not accept blocking/release commands if it is positioned on a tank 13 different from the one to which it is coupled.

In this way, it is not possible to deceive the system by inserting in the blocking device 15 a valve separate from the tank or a valve equipped with an RFID tag or another tag. In fact, the identifier number (UID) of the RFID tag is unique, and it is hence not possible to duplicate the tag of a specific tank 13.

It is envisaged that the RFID tag will operate also for detection of position; namely, the device 15 accepts commands only if it is completely fitted and pressed right down on the valve 14 in order to prevent the system being misled only by resting the blocking device 15 on the valve, below the maximum reading distance of the RFID system.

Hence, the detection distance of the RFID-tag reader in the blocking device 15 must be calibrated to the minimum value so that the tag is read only when the antenna of the RFID-reader device is made to faces right onto it and hence the blocking device 15 is effectively inserted on the valve 14.

Use of the RFID system described herein also ensures the further advantage that it is possible to mark with a unique identifier number (UID) all the tanks on which a blocking device 15 is mounted, enabling further operations of control and management of the tanks.

As has been mentioned, the RFID detection system preferably replaces the proximity sensor 31 of an inductive type. Preferably, it is implemented according to the NFC standard (ISO 14443), which affords the advantage of operating at high frequency (HF), and hence is less sensitive to electromagnetic interference and to signal absorption caused by the surrounding metal, unlike UHF systems. It is moreover a more widespread standard, which makes it possible to choose from a larger number of different types of RFID tags.

In FIG. 7, by way of example, an NFC RFID reader 131 is illustrated, inserted in the electronic card 30 of the blocking device 15, which, as has been said, is supplied from outside via WPC signals. The energy necessary for operation of the reader 131 is in any case lower than that supplied by the wireless supply system of the blocking device 15, and in general its use is not required simultaneously with use of the actuator 20 of the blocking device 15.

The RFID reader 131 is connected via a miniaturized coaxial cable 131*a* to an RFID coil antenna 132, provided on a PCB. The antenna 132 is sized so as to optimize the reading distance (minimum distance) for operation with the surrounding metal and detection of position, according to the type of RFID tag used. The PCB is housed in a plastic container, open on the antenna side, which is filled with sealing epoxy resin. The antenna and the coaxial cable that come out therefrom are hence waterproof and can be mounted in view in the blocking device 15, i.e., without any safety casings.

The RFID antenna 132 is mounted, fixed via adhesive, preferably in a cavity of the bottom part of the blocking portion 152, in a position corresponding to, i.e., at the height of, a hexagonal collar 134 set above the end 142 of the valve 14 and underneath the groove in which the pin 21 engages, inserted in a fluid-tight way in the gas tank 13, so that the antenna 132 will face the valve 14 on the side opposite to the blocking pin 21. The aforesaid metal hexagonal collar 134 is normally present in the valves 14 for gripping purposes; in fact, it is visible also in FIG. 3.

The coaxial cable 131*a* comes from the housing of the card 30, for example in the form of chamber 161, through a via, i.e., a passage hole, not illustrated in FIG. 7, which is then closed by the resin that seals the chamber 161 or in any case that embeds the electronic card 30.

It is envisaged to mount preferably a collar 135 made of plastic material, to be mounted in a permanent way on each filling valve 14 both of tanks already installed and on new tanks. The collar 135 contains an RFID tag 133 embedded and sealed with resin in a cavity of the collar 135 itself, at the same time guaranteeing an adequate reading distance from the RFID antenna.

The collar made of plastic material, and not of metal, does not interfere with reading of the RFID tag 133 by the reader. Furthermore, it sets the RFID tag 133 a few millimeters apart from the metal of the valve 14, once again to enable reading by the RFID reader 131.

The collar 135 has substantially the shape of a ring of plastic material. It is preferably configured for being inserted in a unique way in the blocking device 15 so as to present always the RFID tag in front of the RFID antenna: in the ring of the collar 135 there may be an asymmetry (rectified portion) or else a contrast with the inside of the blocking device 15. The collar 125 is preferably fitted around the hexagonal collar 134 of the valve 14 via a knurled coupling obtained around the inner circumference of the collar: in this way, the collar 135 (and hence the blocking device 15, which bears thereon) can be mounted on the tank 14 with any angle in the horizontal plane in order to adapt to the overall dimensions of the accessories already present. Once, in an installation step, the optimal position of the device 15 has been defined, the collar 135 is glued in a permanent way with thixotropic (high-density) epoxy resin. From that moment the valve 14 and the tank 13 on which it is mounted can be identified in a unique way, both via the remote control 12 and via the smartphone provided with NFC or separate RFID reader.

It is envisaged to carry out reading of the UID code of the valve 14 for verifying the position, and recognition of the particular valve coupled to the blocking device 15 (which stores the UID code thereof in a permanent way) is the condition to be verified for the device 15 to accept a blocking or release command from the terminal 12.

For initial installation, a command of first coupling will be implemented in the terminal 12. Via this command the operator can force a new device 15, i.e., one that has not yet been coupled and is positioned on a valve 14, to read and store the UID code of the valve 14 itself. From that moment the blocking device 15 accepts commands only if it is positioned on the valve to which it is coupled. The procedure of first coupling can be performed by the operator terminal 12 just once, on each new device 15, even though it is possible to implement a command for annulling coupling, accessible in the terminal 12 via codes reserved, for example, to the manufacturer or to the maintenance staff.

In variant embodiments, the solution described herein also regards a system of from unauthorized access to a valve of a fuel-gas tank, the valve enabling execution of operations of filling of the tank 11 and being associated to blocking means 15 at least between a closing position and an opening position actuated by actuator means 20, which operate with electromagnetic energy, the system comprising a wireless terminal 12 configured for governing the aforesaid actuator means 20, wherein:

the wireless terminal 12 comprises means 65 for sending a charging signal WD, which includes a data signal portion D and a supply portion W carrying energy via electromagnetic induction, in particular a WPC (Wireless Power Consortium) signal;

the blocking means 15 being configured for receiving energy from the supply portion W of the charging signal WD for operating the aforesaid actuator means 20; and the blocking means 15 further comprising control means 70 that enable operation of the actuator means 20 according to a data signal portion D of the charging signal WD exchanged with corresponding control means 60 of the wireless terminal 12.

The system described presents the advantages outlined hereinafter.

In general, the access system according to the invention envisages, via a blocking device on the valve, preventing non-authorized staff (hence staff not able to remove the block) from being able to refuel the gas tank or ill-intentioned persons from taking gas out of the tank or tampering with the tank. This is obtained with a blocking device that is without an internal energy source, thus providing a completely sealed device designed for a potentially explosive environment (ATEX 0). The energy necessary for verification of operator authorization and for supply of the blocking/release electromechanical device arrives in wireless mode from the communication terminal, which is a portable device with autonomous supply, used by the operator for blocking or releasing the blocking device. The control module of the terminal is supplied by an internal rechargeable battery. Since the control module of the terminal is a completely sealed unit designed for a potentially explosive environment (ATEX 0), recharging of the battery is performed in wireless mode, via a battery charger on which the terminal is rested in contact therewith, to enable recharging.

Furthermore, advantageously, only control modules enabled in the terminal, and hence able to pass the cryptographic check required by the blocking device, can block/release the latter.

The control module of the terminal moreover advantageously traces the blocking/release operations performed, together with the complementary data (date, time, geographical position, operator code) and transfers this information (via 3G) directly onto the server of the company that manages gas refueling.

Of course, without prejudice to the principle of the invention, the details and the embodiments may vary, even considerably, with respect to what has been described herein purely by way of example, without thereby departing from the sphere of protection, this being defined by the annexed claims.

The present access system regards tanks for fuel gas, used in the gaseous form for combustion, but of course in the tank the aforesaid gas may be stored in prevalently liquid form.

The communication terminal according to the invention is set in contact with the blocking device, where by "contact" is understood a distance such as to enable correct transmission and reception of the charging signal, in particular WPC signal.

The invention claimed is:

1. A system of protection from unauthorized access to a valve of a fuel-gas tank, comprising:

a valve (14) configured for enabling execution of operations of filling of a tank;

a blocking device (15), separate from, but in communication with, said valve (14), that co-operates with said valve (14) for blocking, between a closing position and an opening position, access to said valve (14); wherein the blocking device (15), when in the closing position, blocks access to said valve (14), thereby blocking fluid flow and preventing the operations of filling a tank, whether said valve (14) is open or closed; wherein said blocking device (15) is operated between the closing and the opening positions by an actuator (20) supplied with electrical energy; and a wireless terminal (12) configured for governing said actuator (20);

wherein:

said wireless terminal (12) comprises a transceiver (65) for sending a charging signal (WD) that includes a data signal portion (D) and a supply portion (W), which carries energy via electromagnetic induction, in particular a WPC (Wireless Power Consortium) signal;

said blocking device (15) being configured for receiving electrical energy from said supply portion (W) of said charging signal (WD) to operate said actuator (20), said blocking device (15) further comprising a first control module (70) that enables operation of said actuator (20) according to the data signal portion (D) of the charging signal (WD) exchanged with a corresponding second control module (60) of the wireless terminal (12).

2. The access system according to claim 1, wherein said second control module (60) of the terminal (12) and said first control module (70) of the blocking device (15) comprise respective modules (67, 76) for carrying out steps of cryptographic check (260) of an authorization of the second control module (60) of the terminal (12) to operate on the blocking device (15) comprised in said data signal portion (D) of the charging signal (WD).

3. The system according to claim 1, wherein said blocking device (15) comprises a charging-signal receiver (71) for receiving the charging signal (WD) sent by the terminal (12) and a supply unit (72) for converting energy received by the receiver for supplying the first control module (70) of the blocking device (15) and supplying the actuator (20).

4. The system according to claim 1, wherein said terminal (12) is supplied via a battery (63) and is configured for charging said battery (63) via a further charging signal (R) sent by an external battery-charger module (50).

5. The system according to claim 1, wherein said blocking device (15) comprises a body (151) that includes a blocking portion (153) associated with the valve (14) and a housing portion (152) for housing the actuator (20), said actuator (20) operating in a fluid-tight way in said body (151) with respect to said blocking portion (153).

6. The system according to claim 1, wherein said blocking device (15) comprises a blocking portion (153) in which an inlet portion (141) of the valve (14) is inserted and the actuator (20) is configured, in a position, for applying a pin (21) in a blocking seat of said inlet portion (141) inserted in said blocking portion (153).

7. The system according to claim 1, wherein said blocking device (15) comprises a sensor for detecting a position of the actuator (20) and a sensor for detecting a position of the valve (14), and the first control module (70) of the blocking device (15) comprises a module configured for comparing information of said sensors (31, 20*a*).

8. The system according to claim 1, wherein said blocking device (15) comprises RFID-tag devices (131, 132), the valve (14) comprises an RFID tag (133) including a given identifier code, and said first control module (70) of the blocking device (15) is configured for carrying out blocking or release only for a given identifier code associated with the RFID tag (133) detected on the valve (14).

9. A method for access to a valve of a fuel-gas tank, the method using a system comprising:

a valve (14) configured for enabling execution of operations of filling of a tank;

a blocking device (15), separate from, but in communication with, said valve (14), that co-operates with said valve (14) for blocking, between a closing position and an opening position, access to said valve (14); wherein the blocking device (15), when in the closing position, blocks access to said valve (14), thereby blocking fluid flow and preventing the operations of filling a tank, whether said valve (14) is open or closed; wherein said blocking device (15) is operated between the closing and the opening positions by an actuator (20) supplied with electrical energy; and a wireless terminal (12) configured for governing said actuator (20);

wherein:

said wireless terminal (12) comprises a transceiver (65) for sending a charging signal (WD) that includes a data signal portion (D) and a supply portion (W), which carries energy via electromagnetic induction, in particular a WPC (Wireless Power Consortium) signal;

said blocking device (15) being configured for receiving electrical energy from said supply portion (W) of said charging signal (WD) to operate said actuator (20);

said blocking device (15) further comprising a first control module (70) that enables operation of said actuator (20) according to the data signal portion (D) of the charging signal (WD) exchanged with a corresponding second control module (60) of the wireless terminal (12); wherein the method comprises the steps of:

applying the wireless terminal (12) in contact with the blocking device (15), supplying a charging signal (WD) to said blocking device (15) that comprises a supply portion (W), and exchanging with said blocking device (15) a sequence of commands via said data signal portion (D), said sequence comprising a command (SB) for blocking or opening of said blocking device (15).

10. The method according to claim 9, wherein said sequence of commands comprises an authorization of the second control module (60) of the terminal (12) to operate on the blocking device (15).

11. The method according to claim 9, wherein said second control module (60) of the terminal (12) and said first control module (70) of the blocking device (15) carry out the following operations:

activation (210) in the terminal (12) of operation or mode of blocking/release of the valve by entering a valid activation code (A) in the terminal (12);

entry (230) of the terminal (12) into a blocking/release mode of the blocking device (15), which is active for a given time, sufficient for carrying out refueling with gas;

sending (240) of a release or blocking command (SB) via the terminal (12) to the blocking device (15);

detection (250) by the blocking device (15) of the release/blocking command (SB) in the data portion (D) sent by the terminal (12);

execution of a verification (260) of authorization of the terminal (12); and acceptance and execution (270) by the blocking device (15) in a case of positive outcome of the verification (260).

12. The method according to claim 11, wherein said verification (260) of authorization of the terminal (12) comprises the following steps:

sending (262) from the blocking device (15) to the terminal (12) a value of encryption key (K), in particular with AES (Advanced Encryption Standard) or SHA-256 (Secure Hash Algorithm) encoding;

sending (264) from the blocking device (15) a numeric value in the clear (CK), which identifies a type of key used; and decoding (266), at the terminal (12), the value of encryption key (K) received and sending in response, to the blocking device (15), a corresponding decoded key (KD).

13. The method according to claim 11, further comprising the step of verification by the terminal (12) of a presence of a refueling tanker (11).

14. A blocking device used in a system for protection from unauthorized access to a valve of a fuel-gas tank, where the blocking device (15):

is separate from, but in communication with, a valve (14) of the system, the valve (14) configured for enabling execution of operations of filling of a tank;

co-operates with the valve (14) for blocking, between a closing position and an opening position of the blocking device (15), access to the valve (14);

when in the closing position, blocks access to the valve (14), thereby blocking fluid flow and preventing the operations of filling the tank, whether the valve (14) is open or closed;

is operated between the closing and the opening positions by an actuator (20) supplied with electrical energy, where the actuator (20) is governed by a terminal (12); the terminal (12) comprising a transceiver (65) for sending a charging signal (WD) that includes a data signal portion (D) and a supply portion (W), which carries energy via electromagnetic induction, in particular a WPC (Wireless Power Consortium) signal;

is configured for receiving electrical energy from said supply portion (W) of said charging signal (WD) to operate said actuator (20);

further comprises a first control module (70) that enables operation of said actuator (20) according to the data signal portion (D) of the charging signal (WD) exchanged with a corresponding second control module (60) of the wireless terminal (12).

15. The blocking device according to claim 14, wherein said second control module (60) of the terminal (12) and said first control module (70) of the blocking device (15) comprise respective modules (67, 76) for carrying out steps of cryptographic check (260) of an authorization of the second control module (60) of the terminal (12) to operate on the blocking device (15) comprised in said data signal portion (D) of the charging signal (WD).

16. The blocking device according to claim 14, further comprising a charging-signal receiver (71) for receiving the charging signal (WD) sent by the terminal (12) and a supply unit (72) for converting energy received by the receiver for supplying the first control module (70) of the blocking device (15) and supplying the actuator (20).

17. The blocking device according to claim 14, further comprising a body (151) that includes a blocking portion (153) associated with the valve (14) and a housing portion (152) for housing the actuator (20), said actuator (20) operating in a fluid-tight way in said body (151) with respect to said blocking portion (153).

18. The blocking device according to claim 14, further comprising a blocking portion (153) in which an inlet portion (141) of the valve (14) is inserted and the actuator (20) is configured, in a position, for applying a pin (21) in a blocking seat of said inlet portion (141) inserted in said blocking portion (153).

19. The blocking device according to claim 14, further comprising a sensor for detecting a position of the actuator (20) and a sensor for detecting a position of the valve (14), and the first control module (70) of the blocking device (15) comprises a module configured for comparing information of said sensors (31, 20*a*).

20. The blocking device according to claim 14, further comprising RFID-tag devices (131, 132), the valve (14) comprises an RFID tag (133) including a given identifier code, and said first control module (70) of the blocking device (15) is configured for carrying out blocking or release only for a given identifier code associated with the RFID tag (133) detected on the valve (14).

* * * * *